US006065447A

United States Patent [19]

Saeki et al.

[11] Patent Number: 6,065,447

[45] Date of Patent: May 23, 2000

[54] IDLE SPEED CONTROL DEVICE FOR INTERNAL COMBUSTION ENGINE

[75] Inventors: Hiroaki Saeki, Hitachinaka; Tomio Hokari, Mito, both of Japan

[73] Assignees: Hitachi, Ltd., Tokyo; Hitachi Car Engineering Co., Ibaraki, both of Japan

[21] Appl. No.: 09/246,733

[22] Filed: Feb. 9, 1999

[30] Foreign Application Priority Data

Feb. 12, 1998 [JP] Japan ..... 10-029507

[51] Int. Cl.[7] ..... F02M 69/32

[52] U.S. Cl. ..... 123/339.27

[58] Field of Search ..... 123/339.27, 339.25, 123/339.23, 585; 251/129.17

[56] References Cited

U.S. PATENT DOCUMENTS

| | | | |
|---|---|---|---|
| 4,424,952 | 1/1984 | Thomson et al. | 251/54 |
| 4,580,536 | 4/1986 | Takao et al. | 123/339.27 |
| 4,617,889 | 10/1986 | Nishimiya | 123/339.27 |
| 4,989,564 | 2/1991 | Cook et al. | 123/339.27 |
| 5,090,381 | 2/1992 | Tanabe | 123/339.27 |
| 5,217,043 | 6/1993 | Novakovi | 137/460 |
| 5,307,774 | 5/1994 | Hammer | 123/339.27 |
| 5,325,830 | 7/1994 | Hammer | 123/339.27 |
| 5,687,695 | 11/1997 | Tsukamoto et al. | 123/339.27 |

FOREIGN PATENT DOCUMENTS

| | | | |
|---|---|---|---|
| 1-173356 | of 1989 | Japan . | |
| 5-332471 | of 1993 | Japan . | |
| 06147066 | 5/1994 | Japan | 123/339.27 |

*Primary Examiner*—Henry C. Yuen
*Assistant Examiner*—Hieu T. Vo
*Attorney, Agent, or Firm*—Evenson, McKeown, Edwards & Lenahan, P.L.L.C.

[57] ABSTRACT

An idle speed control device has a valve portion disposed in an auxiliary intake air passage by-passing a throttle valve disposed in a main intake air passage for opening and closing a valve provided in the auxiliary air passage, and a spring urging the valve portion to close. The spring is arranged in a portion separated from the air flow in the auxiliary intake air passage, and the valve portion has a guide portion formed therein to be integrated therewith for guiding sliding of the valve portion.

8 Claims, 4 Drawing Sheets

IDLE SPEED CONTROL DEVICE FOR INTERNAL COMBUSTION ENGINE

BACKGROUND OF THE INVENTION

The present invention relates to an idle speed control device of an internal combustion engine.

In a conventional internal combustion engine idle speed control device disclosed in JP 5-332471, a valve shaft is elongated in an auxiliary intake air passage downstream of a valve portion and a slide guide mechanism for guiding the valve shaft extends into the auxiliary intake air passage from an intake air passage wall surface. Further, a spring for urging the valve portion so as to open it is arranged in the peripheral portion of the slide guide mechanism for the valve shaft arranged in the intake air passage. Still further, devices as disclosed in U.S. Pat. Nos. 4,424,952, 4,984,564, 5,217,043, or JU 1-173356 are also known.

SUMMARY OF THE INVENTION

With the construction as mentioned above, fluid pressure of air flowing in the auxiliary intake air passage acts on the spring to cause the spring to resonate and vibrates the valve portion, whereby there is left a problem that the vibration causes pressure waves and noises and disturbs flow rate characteristics.

Further, since the slide guide mechanism is in the auxiliary intake air passage, a sectional area of the auxiliary intake air flow passage becomes small, as a result, there is left a problem that a flow rate is suppressed to be small.

An object of the present invention is to suppress resonance of a valve portion with such structure that the fluid pressure of air does not act on a spring.

Another object of the present invention is to provide an internal combustion engine idle speed control device which has large and stable flow rate characteristics by securing a sufficient sectional area of an auxiliary intake air passage without obstruction to movement of a valve portion.

In order to attain the above objects, the present invention is constructed so that a spring for urging a valve portion so as to open is arranged in a space separated from an air flow in an auxiliary intake air passage.

Further, in order to attain the above objects, another invention is constructed so that a guide portion for guiding forward and backward movement of a valve portion is formed in and integrated with the valve portion and a bearing portion for guiding the guide portion of the valve portion is formed in a valve seat portion.

According to the present invention constructed as mentioned above, the spring for urging the valve portion so as to open is not influenced by an air flow flowing in the auxiliary intake air passage, so that the valve portion can be avoided to be resonated and noises can be suppressed. Further, according to another invention having the latter construction, since a sufficient sectional area of the auxiliary intake air passage can be secured, a maximum flow rate can be made large and the flow rate characteristics at a high valve opening region can be made more stable than a conventional idle speed control device.

According to the present invention, noises can be suppressed by arranging the spring, for urging the valve portion so as to open the valve portion, in a portion separated from an air flow in the auxiliary intake air passage. Further, a maximum value of the air flow rate characteristics of the idle speed control device can be made large and the flow rate characteristics at a high valve opening region can be made stable, by securing the sectional area of the auxiliary intake air passage.

DESCRIPTION OF THE PREFERRED EMBODIMENTS

Figure 1:
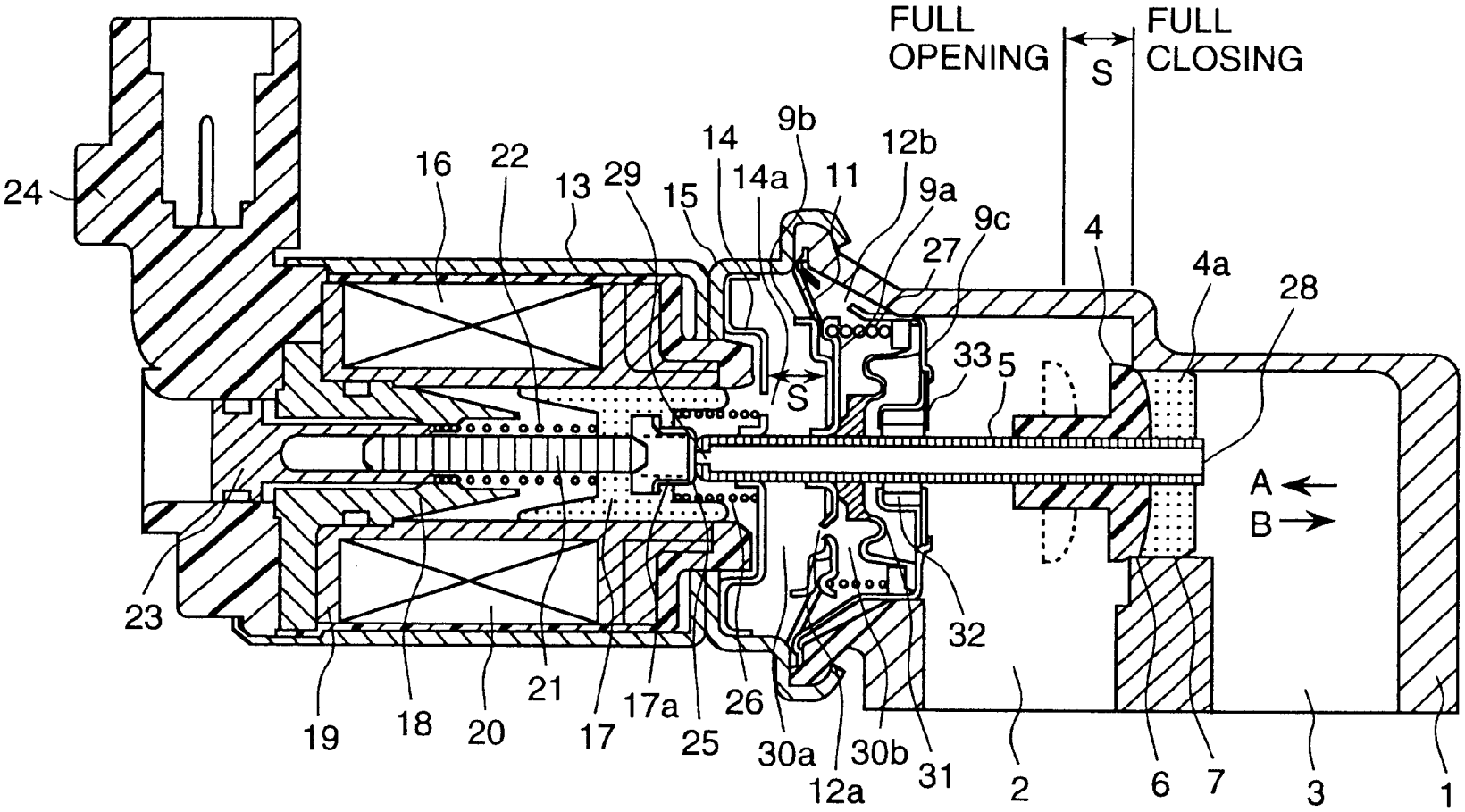
FIG. 1 is a sectional side view of an idle speed control device of an embodiment of the present invention.

An embodiment of the present invention will be explained hereunder, referring to the drawings. First of all, the whole construction will be explained, referring to FIG. 1, and successively an operation thereof will be explained.

In FIG. 1, an idle speed control device is composed of a body (valve body) 1 positioned mainly in a right side of FIG. 1 from the center and provided with a valve portion and a solenoid portion 16 positioned mainly in a left side of FIG. 1 and driving the valve portion. Separately from a main intake air passage in which a throttle valve is arranged, an auxiliary intake air passage is formed so as to bypass the throttle valve. The body 1 forms a portion 2,3 of the auxiliary intake air passage, one part of which is an inflow passage 2 connected with the main intake air passage upstream of the throttle valve and the other is an outflow passage 3 connected with the main intake air passage downstream of the throttle valve.

Figure 2A:
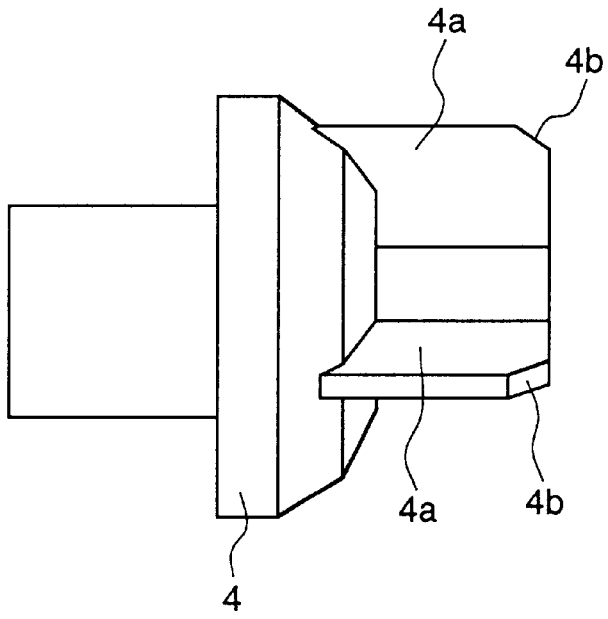
FIG. 2*a* is a side view of a valve portion.
Figure 2B:
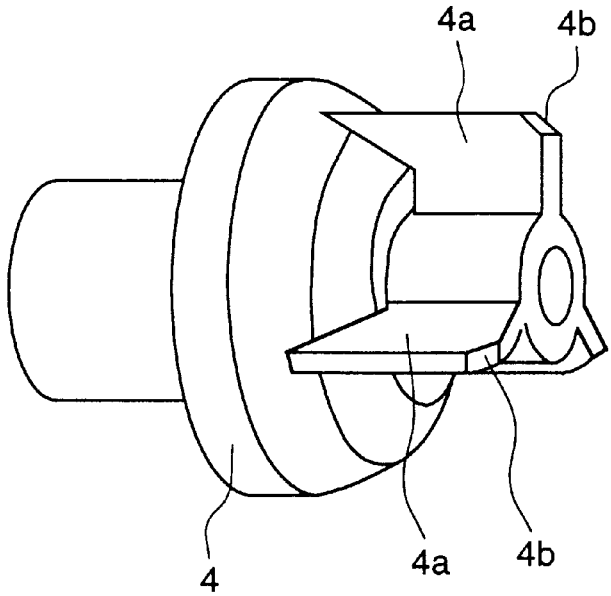
FIG. 2*b* is a perspective view of the valve portion.
Figure 3:
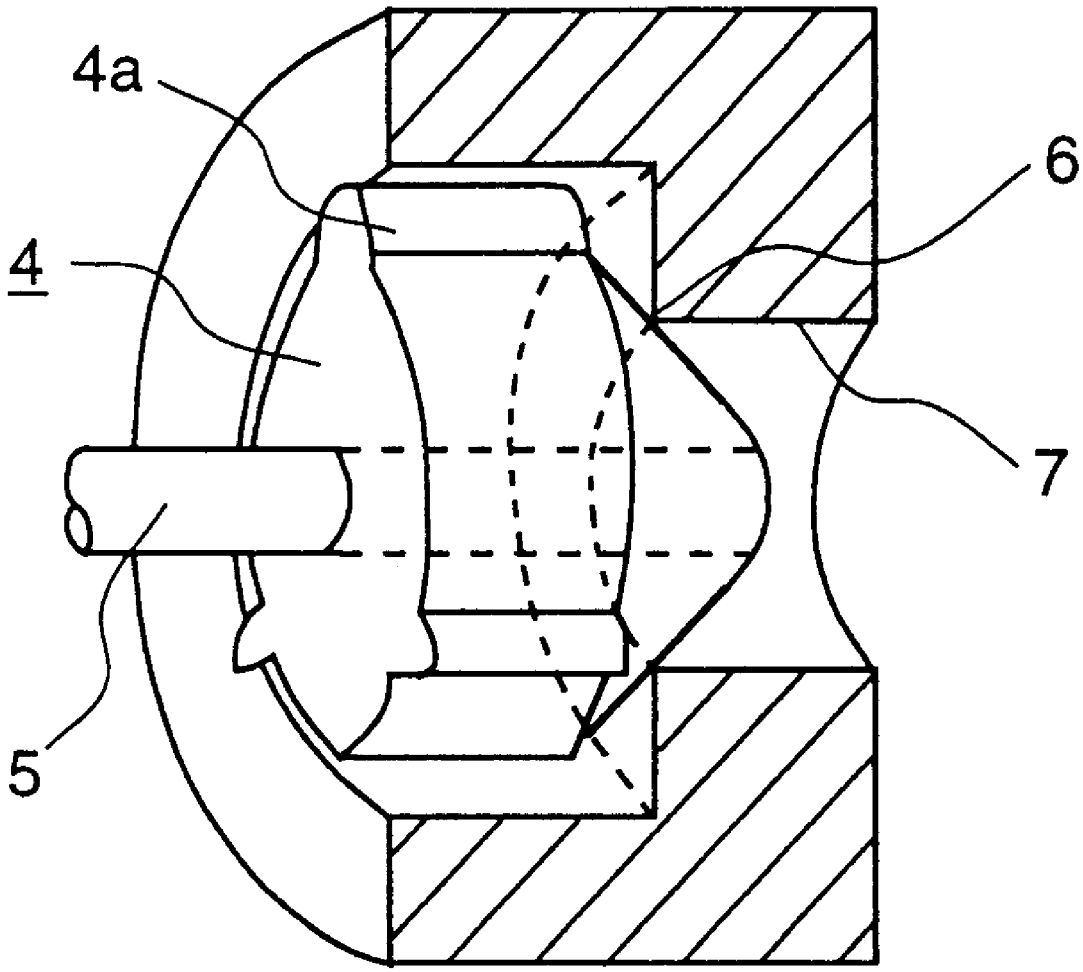
FIG. 3 is a perspective view of a valve portion of another embodiment of the present invention.

The valve portion 4 is fitted on a hollow shaft at one end, and made of poly phenylene sulfide resin (PPS resin), for example and shaped as shown in FIGS. 2*a*, 2*b* and FIG. 3 by molding. Under the condition of FIG. 1, the inflow passage 2 and the outflow passage 3 are interrupted to communicate with each other and the valve portion 4 is closed. Upon sliding of the shaft 5 in a direction of arrow A, the inflow passage 2 and the outflow passage 3 are communicated and the valve portion 4 is opened. Guide portions 4*a* of the valve portion 4 are inserted in a cylindrical passage 7 (bearing portion) and guide sliding movement of the shaft 5 at a right end portion when the shaft 5 slides in the directions of arrows A and B.

The shaft 5 is guided by a bearing plate 14 fixed to a cover 15 at the left side portion and by a rubber damper 32 at a central portion. A pilot port (orifice) 29 is formed at a left side end portion of the shaft 5 and restricting inflow of negative pressure air flowing in from an open port 28 at a right side of the shaft 5. Further, the shaft 5 is press-fitted in and fixed to a plate 9*a* and plate 9*b* joined each other by welding to be one piece.

An inner ring portion of a diaphragm 11 is sandwiched between the plates 9*a*, 9*b*, and an outer ring portion of the diaphragm 11 is sandwiched between the body 1 and a solenoid case 13 and sealingly fixed thereto. An orifice 12*a* provided in the plates 9*a*, 9*b* is restricting the air flowing out from a left space 30*a* into a right space 30*b* separated from the left space 30*a* by the plates 9*a*, 9*b* and the diaphragm 11.

An outer ring portion of a plate 9*c* is sandwiched between and fixed by the body 1 and the solenoid case 13 in a similar manner to the diaphragm 11. The rubber damper 32 is fixed to an inner ring portion of the plate 9*c* by a cover 33. The rubber damper 32 slidably supports the shaft 5 at its inner peripheral side. The rubber damper 32 is provided for prevention of backlash of the shaft 5 due to vibrations of the vehicle body. Further, a hole 12*b* is formed in plate 9*c*.

A partition material (boots) 31 reducing action of pressure waves occurring upstream of the valve portion onto the diaphragm is fixed between the plates 9*a* and 9*c*.

Further, a spring 27 is arranged between the plates 9*a* and 9*c*. The plates 9*a*, 9*c* each are rigid, however, the diaphragm 11 has flexibility and is deformable. The spring 27 is urging the plate 9*a* and the shaft 5 by spring force in a direction of arrow A (in the direction that the valve is opened). The bearing plate 14 has a cylindrical portion at the center, and the cylindrical portion supports and guides a left end portion of the shaft 5. The bearing plate 14 has a plurality of holes 14*a*.

Under the condition that only spring 22 and spring 26 pressing both sides of a plunger 17 are provided, since spring force of the spring 22 is stronger than that of the spring 26, the plunder 17 is urged in a direction of arrow B (in the direction that the valve portion 4 is closed), and the valve portion 4 is closed. However, the idle speed control device is adjusted by providing the spring 27 so that the valve portion 4 is open even when the device is delivered or when the engine is stopped. This is for preventing the valve portion 4 from being adhered to the body 1 and becoming not opened, and from deforming in shape of the valve portion due to contamination with carbons, adhesion of gasoline to rubber materials, etc. Further, with this construction, the shaft 5 is urged toward a control seat 25 by the spring force of the spring 27, so that the shaft 5 can follow the position of the control seat 25 even when negative pressure at the side of the outflow passage 3 is small or null.

Figure 4:
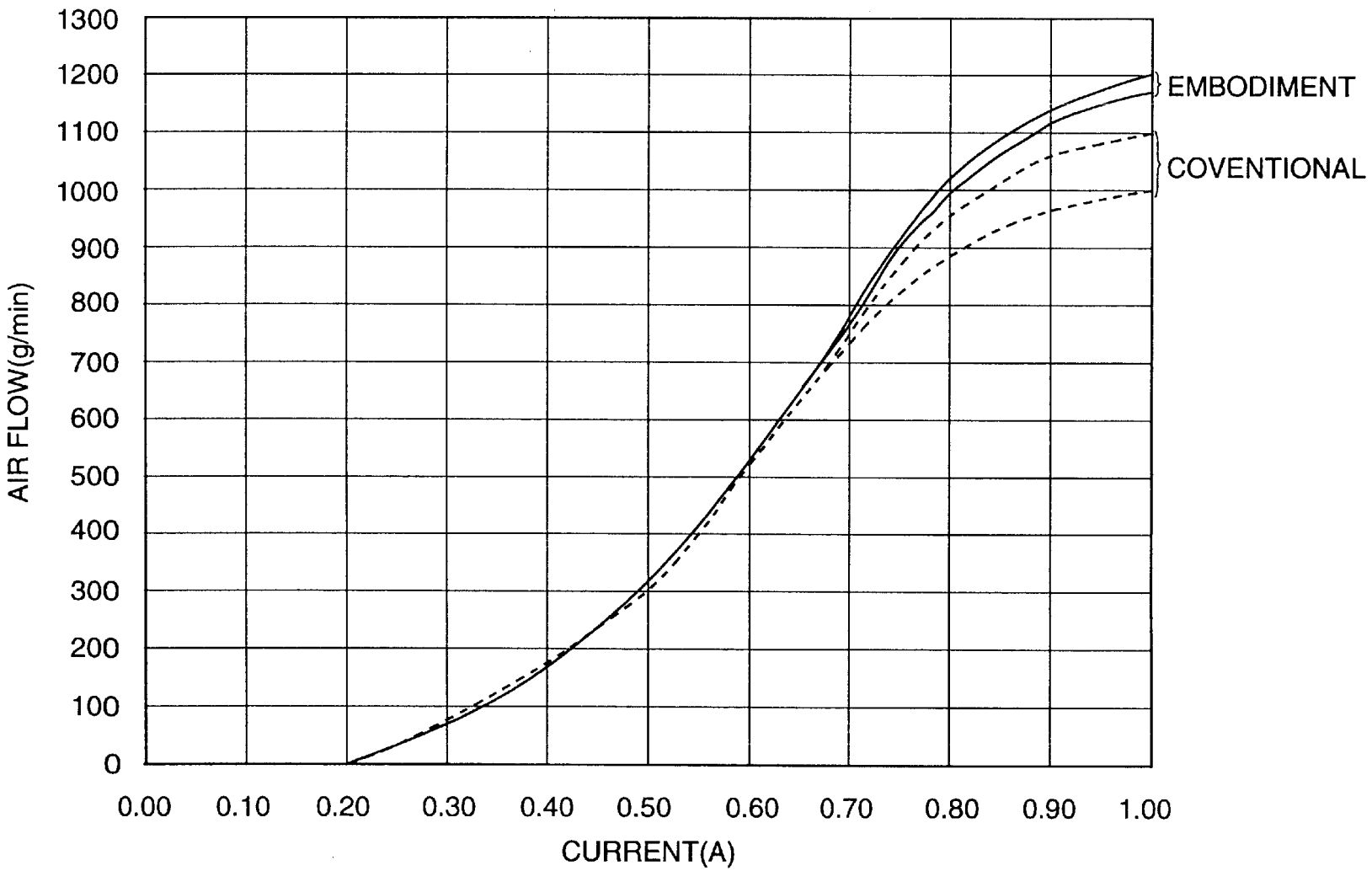
FIG. 4 is a diagram of flow rate characteristics of the present embodiment.

Negative pressure is generated downstream of the valve portion when the engine is running. The force pulling the valve portion 4 in the valve closing direction, which force is generated by the negative pressure, is larger than the resultant spring force urging the valve portion 4 in the valve opening direction, so that the valve portion 4 is closed. That is, the spring 27 is adjusted so that the valve portion 4 is opened at the time of stopping of the engine and closed by the negative pressure during operation of the engine. Therefore, the valve portion 4 can not be opened during operation of the engine without flowing electric current more than a certain amount into the solenoid. In the present embodiment, electric current more than 0.2 A is necessary for opening the valve portion 4 (refer to FIG. 4).

Next, a construction will be explained of a solenoid portion positioned at a left side of FIG. 1 and covered with the solenoid case 13. The solenoid 16 accommodated in and fixed to the solenoid case 13 is composed of the plunger 17 which is axially movable, a core 18 attracting the plunger 17, a bobbin 19 slidably holding the plunger 17 and holding an annular coil 20, the spring 22 against the force attracting the plunger 17 and an adjust screw 23 adjusting a set load of the spring 22 and supporting the shaft 5 at the left side of the plunger 17 by a bearing hole at the center. Those components are molded with a coil-exterior mold 24. Further, a plug is inserted in an opening portion provided with the adjust screw 23 and served for water prevention and dust prevention after adjusting the set load of the spring 22.

The control seat 25 is inserted in a concave portion at the right side of the plunger 17 and fixed by an annular stopper 17*a*. The control seat 25 has a surface of stainless steel on which a rubber sheet is adhered, and the surface of the rubber sheet is abutted on the left end of the shaft 5 at which the orifice 29 is formed. A spring is provided between the plunger 17 and the stopper 17*a*. The spring serves as a damper, and damps so as not to damage the control seat 25 even if the shaft 5 hits the control seat 25. The spring 26 pressing the plunger 17 toward the side of the adjust screw 23 is provided between the bearing plate 14 and the stopper 17*a*.

Next, an operation of the fluid control valve of the present embodiment will be explained hereunder. Under the condition that the engine is running, intake air negative pressure is occurring, and the negative pressure is applied in the outflow passage 3. Therefore, the valve portion 4 is attracted by the negative pressure to slide in the direction of arrow B and the outflow passage 3 is closed.

Here, as the electric current applied in the annular coil 20 of the solenoid portion is increasing, the plunger 17 is moved to the side of the core 18 when the attracting force becomes larger than the negative pressure. The control seat 25 also moves together with the plunger 17, so that the control seat 25 separates from the left end portion of the shaft 5. Thereupon, the negative pressure applied in the hollow shaft 5 passes through the orifice 29 and hole 14*a* through the opening port 28, and then is introduced into the left space 30*a*. The diaphragm 11 is pulled in the direction of arrow A by the negative pressure introduced there, and the shaft 5 inserted in and fixed to the plates 9*a*, 9*b* is moved in the left direction (in the direction of arrow A), whereby the valve portion 4 fitted on the shaft 5 is opened. The passage mechanism is so made that the negative pressure applied on the diaphragm at this time passes through the hole 12*b* through the orifice 12*a* and then gradually leaks into atmosphere from the inflow passage 2.

The diaphragm 11 moves left by the negative pressure, at the same time, when the orifice 29 at the left end portion of the shaft 5 contacts with the control seat 25 and is closed, the passage for the negative pressure is closed. Thereby, the negative pressure in the left space 30*a* gradually leaks into atmosphere from the orifice 12*a* and decreases, whereby the force pulling the diaphragm 11 decreases, so that the shaft 5 moves in the right direction (in the direction of arrow B) by the attracting force in the B arrow direction caused by the negative pressure in the outflow passage 3. By this movement of the shaft 5, the orifice 29 at the left end portion of the shaft 5 is opened and the negative pressure is introduced into the left space 30*a*.

By repetition of the above-mentioned operation, the shaft 5 moves following the position that the plunger 17 moved, and the shaft 5 is held at the position that a slight gap (50–100 $\mu$m or so) is formed between the control seat 25 and the orifice 29. That is, with a self position adjusting mechanism using the intake negative pressure from the engine, it is possible to hold the shaft 5 at the position of the control seat 25 taken corresponding to a magnitude of electric current to the annular coil 20 of the solenoid 16. Since such an intake negative pressure servo method is used, the solenoid 16 can be made small in size, compared with the case where the shaft 5 is directly driven.

Next, the structure of the valve portion will be explained, referring to FIGS. 2*a* and 2*b*.

The valve portion 4 is provided with three guide portions 4*a* each radially extending from the central axis. This is a bearing portion in which the guide portions 4*a* and the inner peripheral surface of the passage 7 slide relatively to each other and the inner peripheral surface of the passage 7 guides the outer peripheral portions of the guide portions 4*a*.

The valve portion 4 has a tapered shape for matching with a flow passage opening port portion (valve seat portion) 6 and axial sliding movement of the valve portion 4 opens and closes the flow passage opening portion 6. The valve portion 4 is provided with ribs (guide portion) 4*a* each extending in parallel with the central axis and having thickness of 1 mm. The guide portions 4*a* each have length of 5 mm from a contact seating point between the valve portion 4 and the flow passage opening port portion 6 toward a downstream side in a parallel direction to the central axis. The length is necessary for the valve portion 4 not to be outside the passage 7 even if the valve portion 4 takes a maximum stroke in the axial direction.

The guide portions 4a are circumferentially separated 120° from each other and each slide in the inner peripheral surface of the passage 7. The valve portion 4 slides in the axial direction, whereby the valve portion 4 controls an opening area of the flow passage opening port portion 6 by the tapered shape portion thereof, at the same time, guides sliding movement thereof by the guide portions 4*a* to suppress deflection of the valve portion 4 in a perpendicular direction to the central axis. Further, a clearance between the guide portions 4*a* and the passage 7 is about 0.2 mm in diameter and about 0.1 mm in radius, the clearance is provided for preventing the slide mechanism from being damaged.

The shaft 5 is supported by the bearing plate 14 at the left side portion, by the rubber damper 32 at the central portion and by the guide portions 4*a* of the valve portion 4 at the right side portion, as mentioned above. As a method of supporting the shaft 5 by three points, a method of inserting the right side end portion of the shaft 5 in a hollow supporting member, for example, can be considered, however, in this method it is necessary to provide the supporting member inside the body 1, as a result, the axial length of the body 1 becomes long and the fluid control valve is made large in size. On the contrary, it is possible to make a fluid control valve compact by providing guide portions in a valve portion itself as in the present embodiment.

Further, another embodiment of a valve portion will be explained hereunder, referring to FIG. 3. The embodiment is concerned with a valve portion shape having guide portions 4*a* at an upstream side of the flow passage opening port portion (valve set portion) 6. A member shown in its section (hatching) is a part of the body 1. In this case, it is necessary to make the height (radial length) of ribs large and secure a sufficient sectional area of clearance.

According to the embodiments as mentioned above, flow rate characteristics as shown in FIG. 4 is obtained.

The same flow rate characteristics as conventional one is obtained until electric current reaches 0.7 A, a larger flow rate than the conventional one can be obtained when the current is larger than that value. This is because a sufficient sectional area of the auxiliary intake air passage is secured by removing extra members. Further, the reason that a variation of flow rate is smaller and more stable than a conventional one is that parts in which a dimensional error occurs are less than the conventional device. That is, the variation in a flow rate is caused by a dimensional error of the outflow passage 3 in the embodiment, while in the idle speed control device by conventional technique, a dimensional error of the supporting member of the shaft is added thereto.

The idle speed control device for internal combustion engine according to the present embodiment can be assembled by only falling the valve portion in the body under the condition that the right side of FIG. 1 is positioned down. According to this assembling method, another assembling tool or jig is unnecessary. This is because the spring for urging the valve portion in a valve-opening direction is formed with the valve portion as an assembly. That is, a deviation of the axial tip end of the valve portion 4 is small because the tip end is short and the guide portions have the tapered portion 4*b*, therefore, the valve portion can be inserted into the passage 7 by only falling the valve portion. Further, the tapered portion 4*b* suppresses occurrence of extra resistance in the tip portion when the guide portions 4*a* slide in the passage 7.

What is claimed is:

1. An idle speed control device for internal combustion engine, having an auxiliary intake air passage by-passing a throttle valve provided in a main intake air passage of an internal combustion engine and communicating an upstream side and downstream side of said throttle valve, a valve body measuring a flow rate of auxiliary air flowing in said auxiliary intake air passage and a driving device for driving said valve body, wherein said valve body comprises a shaft moved forward and backward in an axial direction by said driving device, a valve portion fitted on one end portion of said shaft for opening and closing said auxiliary intake air passage by forward and backward movement of said shaft in cooperation with a valve seat provided in said auxiliary intake air passage, a diaphragm of which an inner peripheral portion is held by a plate fixed to said shaft and an outer peripheral portion is mounted on a member forming said auxiliary intake air passage, a partition wall provided between said valve portion and said diaphragm and forming a part of a wall surface of said auxiliary intake air passage, a spring of which one end abuts said partition wall and the other end abuts said plate, said spring urging said valve portion so as to open with smaller force than a negative pressure generated downstream of said throttle valve during running of the engine.

2. An idle speed control device according to claim 1, wherein a guide portion for guiding the forward and backward movement of said valve portion is formed in said valve portion to be integrated with said valve portion.

3. An idle speed control device for internal combustion engine according to claim 2, wherein said valve portion has a tapered portion the surface of which is inclined to the forward and backward direction of said shaft.

4. An idle speed control device for internal combustion engine according to claim 1 wherein said valve portion has a tapered portion the surface of which is inclined to the forward and backward direction of said shaft.

5. An idle speed control device for internal combustion engine, having an auxiliary intake air passage by-passing a throttle valve provided in a main intake air passage of an internal combustion engine and communicating an upstream side and downstream side of said throttle valve, a valve body measuring a flow rate of auxiliary air flowing in said auxiliary intake air passage and a driving device for driving said valve body, wherein said valve body comprises a shaft moved forward and backward in an axial direction by said driving device, and a valve portion fitted on one end portion of said shaft for opening and closing said auxiliary intake air passage by forward and backward movement of said shaft in cooperation with a valve seat provided in said auxiliary intake air passage, said valve portion having a guide portion formed therein to be integrated therewith for guiding the forward and backward movement of said valve portion, and said valve seat portion having a bearing portion formed therein for guiding said guide portion of said valve portion.

6. An idle speed control device for internal combustion engine according to claim 2, wherein said valve portion has a tapered portion the surface of which is inclined to the forward and backward direction of said shaft.

7. An intake negative pressure servo type idle speed control device for internal combustion engine, operated by driving force of a diaphragm caused by electromagnetic force of a solenoid and air pressure, and having an auxiliary intake air passage by-passing a throttle valve provided in a main intake air passage of an internal combustion engine and communicating an upstream side and downstream side of said throttle valve and a valve body measuring a flow rate of auxiliary air flowing in said auxiliary intake air passage, wherein said valve body comprises a shaft moved forward and backward in an axial direction by said driving device, a valve portion fitted on one end portion of said shaft for opening and closing said auxiliary intake air passage by forward and backward movement of said shaft in cooperation with a valve seat provided in said auxiliary intake air passage, said valve portion having a guide portion formed therein to be integrated therewith for guiding the forward and backward movement of said valve portion, and said valve seat portion having a bearing portion formed therein for guiding said guide portion of said valve portion, a diaphragm of which an inner peripheral portion is held by a plate fixed to said shaft and an outer peripheral portion is mounted on a member forming said auxiliary intake air passage, a partition wall provided between said valve portion and said diaphragm and forming a part of a wall surface of said auxiliary intake air passage, and a first spring of which one end abuts said partition wall and the other end abuts said plate, said first spring urging said valve portion so as to open with smaller force than a negative pressure generated downstream of said throttle valve during running of the engine, and wherein said solenoid comprises a plunger for moving said shaft in the forward and backward direction by opening and closing a pilot port at an end of said shaft, two, second and third, springs each for urging said plunger in an opposite direction to each other, said second spring being for urging said plunger so as to close said pilot port and said third spring being for urging said plunger so as to open said pilot valve, and during stopping of the engine, said valve portion being opened by said first spring and said pilot port being closed by said second spring.

8. An idle speed control device for internal combustion engine according to claim 7, wherein said valve portion has a tapered portion the surface of which is inclined to the forward and backward direction of said shaft.

* * * * *